US007919054B2

(12) United States Patent
Duddy et al.

(10) Patent No.: US 7,919,054 B2
(45) Date of Patent: Apr. 5, 2011

(54) PROCESS AND INSTALLATION FOR CONVERSION OF HEAVY PETROLEUM FRACTIONS IN A BOILING BED WITH INTEGRATED PRODUCTION OF MIDDLE DISTILLATES WITH A VERY LOW SULFUR CONTENT

(75) Inventors: John E. Duddy, Langhorne, PA (US); Lawrence I. Wisdom, Yardley, PA (US); Andrea Gragnani, Paris (FR)

(73) Assignee: IFP Energies Nouvelles, Ruèil Malmaison Cedex (FR)

( * ) Notice: Subject to any disclaimer, the term of this patent is extended or adjusted under 35 U.S.C. 154(b) by 0 days.

(21) Appl. No.: 12/720,156

(22) Filed: Mar. 9, 2010

(65) Prior Publication Data

US 2010/0166621 A1 Jul. 1, 2010

Related U.S. Application Data

(62) Division of application No. 11/370,184, filed on Mar. 8, 2006, now Pat. No. 7,704,377.

(51) Int. Cl.
*B01J 8/00* (2006.01)

(52) U.S. Cl. ..... 422/187; 208/49; 208/57; 208/107

(58) Field of Classification Search ..... 208/49, 208/57, 107

See application file for complete search history.

(56) References Cited

U.S. PATENT DOCUMENTS

| | | | | |
|---|---|---|---|---|
| 6,217,746 | B1 * | 4/2001 | Thakkar et al. | 208/59 |
| 6,387,246 | B1 | 5/2002 | Benazzi et al. | |
| 6,797,154 | B2 | 9/2004 | Mukherjee et al. | |
| 2003/0044348 | A1 | 3/2003 | Sato et al. | |
| 2003/0089638 | A1 | 5/2003 | Gueret et al. | |
| 2004/0138059 | A1 | 7/2004 | Euzen et al. | |

FOREIGN PATENT DOCUMENTS

| | | |
|---|---|---|
| EP | 1 312 661 | 5/2003 |

* cited by examiner

*Primary Examiner* — Robert J Hill, Jr.
*Assistant Examiner* — Brian McCaig
(74) *Attorney, Agent, or Firm* — Millen, White, Zelano & Branigan, P.C.

(57) ABSTRACT

Disclosed are a process and an installation for treatment of a heavy petroleum feedstock, of which at least 80% by weight has a boiling point of greater than 340° C., wherein the process includes (a) hydroconversion in a boiling-bed reactor operating with a rising flow of liquid producing a hydroconversion effluent;

(b) separation of hydroconversion effluent into a gas containing hydrogen and $H_2S$, a fraction comprising gas oil, and a naphtha fraction;

c) hydrotreatment, by contact with at least one catalyst, of at least said fraction comprising gas oil, producing a hydrotreatment effluent; and d) separation of hydrotreatment effluent into a gas containing hydrogen and at least one gas oil fraction having a sulfur content of less than 50 ppm, wherein the hydrogen supply for the hydroconversion and hydrotreatment is delivered by a single compression system.

8 Claims, 4 Drawing Sheets

PROCESS AND INSTALLATION FOR CONVERSION OF HEAVY PETROLEUM FRACTIONS IN A BOILING BED WITH INTEGRATED PRODUCTION OF MIDDLE DISTILLATES WITH A VERY LOW SULFUR CONTENT

This application is a divisional application of U.S. patent application Ser. No. 11/370,184, filed on Mar. 8, 2006 now U.S. Pat. No. 7,704,377.

FIELD OF THE INVENTION

The invention relates to an improved process for conversion of heavy petroleum fractions in a boiling bed with integrated production of gas oil fractions with very low sulfur content, and an installation allowing implementation of said process.

This invention relates to a process and an installation for treatment of heavy hydrocarbon feedstocks containing sulfurous, nitrous and metallic impurities. It relates to a process allowing at least partial conversion of such a hydrocarbon feedstock, for example an atmospheric residue or a vacuum residue obtained by distillation of crude oil, into gas oil that meets sulfur specifications, i.e., having less than 50 ppm of sulfur, preferably less than 20 ppm, and even more preferably less than 10 ppm, and one or more heavy products that can be advantageously used as a catalytic cracking feedstock (such as fluidized-bed catalytic cracking), as a hydrocracking feedstock (such as high-pressure catalytic hydrocracking), as a burning oil with high or low sulfur content, or as a feedstock for a carbon rejection process (such as a coker).

TECHNOLOGICAL BACKGROUND OF THE INVENTION

Until 2000, the authorized sulfur content in diesel fuel was 350 ppm. Much more stringent values have been imposed since 2005 since this maximum content is not to exceed 50 ppm. This maximum value will next be revised downward and should not exceed 10 ppm in a few years.

It is thus necessary to develop processes meeting these requirements without prohibitively increasing the cost of production.

Gasolines and gas oils resulting from the conversion process, such as, for example, hydroconversion, are very refractory in hydrotreatment compared to gas oils that are obtained directly from the atmospheric distillation of crude oils.

To obtain very low sulfur contents, it is necessary to convert the most refractory types, especially di- and trialkylated dibenzothiophenes, or those having a greater degree of alkylation, for which access of the sulfur atom to the catalyst is limited by the alkyl groups. For this family of compounds, the route of hydrogenation of an aromatic cycle before the desulfurization by breaking the Csp3-S bond is faster than direct desulfurization by breaking the Csp2-S bond.

It is likewise necessary to obtain a major reduction of nitrogen content by conversion especially of the most refractory types, especially benzacridines and benzocarbazoles; the acridines are not only refractory, but also inhibit hydrogenation reactions.

Conversion gas oils thus require very rigorous operating conditions to obtain the desired sulfur specifications.

A process of conversion of heavy petroleum fractions including a boiling bed for producing middle distillates with a low sulfur content has been described especially in Patent Application EP 1 312 661. This process, however, makes it possible to reduce sulfur levels below 50 ppm only under very rigorous pressure conditions, which greatly increases the cost of the gas oil that is ultimately obtained.

There is thus a genuine need for a process making it possible to hydrotreat conversion gas oils under less rigorous operating conditions allowing a reduction in investment costs while maintaining a reasonable cycle duration of the hydrotreatment catalyst and allowing sulfur contents of less than 50 ppm, preferably less than 20 ppm, and more preferably less than 10 ppm, to be obtained.

Values in ppm are all expressed by weight.

SUMMARY OF THE INVENTION

The present inventors have found that it is possible to minimize investment costs by optimizing the operating pressures used in obtaining gas oils of good quality having such limited sulfur contents.

DETAILED DESCRIPTION OF THE INVENTION

Thus, the process of the invention is a process of treatment of a feedstock of heavy petroleum of which at least 80% by weight has a boiling point of greater than 340° C., which comprises the following stages:

(a) hydroconversion in a boiling bed reactor operating with a rising flow of liquid and gas at a temperature of between 300 and 500° C., a liquid hourly space velocity relative to the catalyst volume of from 0.1 to 10 $h^{-1}$ and in the presence of 50 to 5000 $Nm^3$ of hydrogen per $m^3$ of feedstock, conversion in % by weight of the fraction having a boiling point of greater than 540° C. being from 10 to 98% by weight;

(b) separation of the effluent obtained from stage (a) into a gas containing hydrogen and $H_2S$, a fraction comprising the gas oil, and optionally a fraction that is heavier than the gas oil and a naphtha fraction;

c) hydrotreatment by contact with at least one catalyst of at least the fraction containing the gas oil obtained in stage (b) at a temperature of from 200 to 500° C., at a liquid hourly space velocity relative to the catalyst volume of 0.1 to 10 $h^{-1}$ and in the presence of 100 to 5000 $Nm^3$ of hydrogen per $m^3$ of feedstock;

d) separation of the effluent obtained at the end of stage (c) into a gas containing hydrogen and at least one gas oil fraction having a sulfur content of less than 50 ppm, preferably less than 20 mm, and even more preferably less than 10 ppm, the hydroconversion stage (a) being conducted at a pressure P1 and the hydrotreatment stage (c) being conducted at a pressure P2, the difference $\Delta P = P1 - P2$ being at least 3 MPa, generally from 3 to 17 MPa, preferably from 8 to 13 MPa, and even more preferably 9.5 to 10.5 MPa, hydrogen supply for the hydroconversion (a) and hydrotreatment (c) stages being ensured by a single compression system with n stages, n being greater than or equal to 2, generally between 2 and 5, preferably between 2 and 4, and especially preferably equal to 3.

The liquid hourly space velocity (LHSV) corresponds to the ratio of the feedstock liquid flow rate in $m^3/h$ per volume of catalyst in $m^3$.

According to the process of the invention, the pressure P1 implemented in the catalytic hydroconversion stage (a) in a boiling bed is between 10 and 25 MPa and preferably between 13 and 23 MPa.

The pressure P2 implemented in the hydrotreatment stage (c) is between 4.5 and 13.5 MPa and preferably between 9 and 11 MPa.

Thus, in the process according to the invention, pressures that are completely different for each of the hydroconversion and hydrotreatment stages can be used; this allows especially significant limitation of investments.

In the process according to the invention, the use of the pressure that is optimum for each particular stage is made possible by implementing a single, multistage hydrogen supply system.

Thus, the hydroconversion stage is supplied with hydrogen originating from delivery from the last compression stage, and the hydrotreatment stage is supplied with hydrogen originating from delivery from an intermediate compression stage, i.e., at a lower total pressure.

According to one particular embodiment, the process of the invention implements a single, 3-stage hydrogen compressor in which the delivery pressure of the first stage is between 3 and 6.5 MPa, preferably between 4.5 and 5.5 MPa, the delivery pressure of the second stage is between 8 and 14 MPa, preferably between 9 and 12 MPa, and the delivery pressure of the third stage is between 10 and 26 MPa, preferably between 13 and 24 MPa.

In one particular embodiment, hydrogen originating from the delivery from the second compression stage feeds the hydrotreatment reactor.

According to one particular embodiment, the partial hydrogen pressure in the hydrotreatment reactor $P2_{H2}$ is between 4 and 13 MPa and preferably between 7 and 10.5 MPa.

These elevated partial hydrogen pressure values are made possible by the fact that all the make-up hydrogen necessary to the process is supplied in stage (c). In this invention, the "make-up hydrogen" is distinguished from the recycled hydrogen. The hydrogen purity is generally between 84 and 100% and preferably between 95 and 100%.

According to another embodiment, the hydrogen supplying the last compression stage can be recycled hydrogen originating from the separation stage (d) and/or the separation stage (b).

This recycled hydrogen can optionally supply an intermediate stage of the compressor that has stages. In this case, it is preferred that said hydrogen has been purified before its recycling.

According to another embodiment, the delivery hydrogen from the initial compression stage and/or from the intermediate stage can, moreover, supply a unit for hydrotreatment of gas oil originating directly from atmospheric distillation, called "straight-run gas oil." As is done conventionally, the straight-run gas oil hydrotreatment unit is operated at a pressure of between 3 and 6.5 MPa and preferably between 4.5 and 5.5 MPa.

According to another embodiment, the delivery hydrogen from an intermediate compression stage can, moreover, supply a soft hydrocracking unit. As is done conventionally, the soft hydrocracking unit is operated at a pressure of between 4.5 and 16 MPa and preferably between 9 and 13 MPa. The gas oil fraction originating from the soft hydrocracking can then supply the hydrotreatment stage (c).

According to another embodiment, the delivery hydrogen from an intermediate compression stage and/or the final compression stage can, moreover, supply a high-pressure hydrocracking unit. As is done conventionally, the high-pressure hydrocracking unit is operated at a pressure of between 7 and 20 MPa and preferably between 9 and 18 MPa.

These units of straight-run gas oil hydroconversion, soft hydrocracking and high-pressure hydrocracking may be present jointly or separately.

The reaction conditions of each of the stages will now be described in greater detail, especially in conjunction with the drawings in which:

FIG. 1 shows a diagram of the installation allowing implementation of one embodiment of the process according to the invention;

FIG. 2 shows a diagram of the installation allowing implementation of another embodiment of the process according to the invention.

The process according to the invention is especially suitable for treatment of heavy feedstocks, i.e., feedstocks of which at least 80% by weight has a boiling point of greater than 340° C. Their initial boiling point is generally established at least 340° C., often at least 370° C. or even at least 400° C. They are, for example, atmospheric or vacuum residues, or deasphalted oils, feedstocks with a high content of aromatic compounds such as those originating from processes of catalytic cracking (such as light gas oil from catalytic cracking called light cycle oil (LCO), heavy gas oil from catalytic cracking called heavy cycle oil (HCO), or a residue of catalytic cracking called slurry oil). The feedstocks can also be formed by mixing these various fractions. They can likewise contain fractions originating from the process that is the object of this invention and those recycled for its feed. The sulfur content of the feedstock is highly variable and is not restrictive. The content of metals such as nickel and vanadium is generally between 50 ppm and 1000 ppm, but is without any technical limitation.

The feedstock is treated first of all in a hydroconversion section (II) in the presence of hydrogen originating from the hydrogen compression zone (I). Then, the treated feedstock is separated into the separation zone (III) where, among other fractions, a gas oil fraction is recovered that then supplies the hydrotreatment zone (IV) where the remaining sulfur is removed therefrom.

Each of these reaction zones is shown in FIGS. 1 and 2. The different physical reactions or transformations carried out in each of these zones will be described below.

Zone (I) represents the compression of hydrogen in several stages (three in the figures). In this zone, the make-up hydrogen is treated, if necessary mixed with the flows of purified recycling hydrogen, to raise its pressure to the level required by stage (a). Said single compression system includes generally at least two compression stages that are generally separated by compressed gas cooling systems, liquid and vapor phase separation units and optionally inputs of the purified recycling hydrogen flows. The breakdown into several stages thus makes available hydrogen at one or more intermediate pressures between that of the input and that of the output of the system. This (these) intermediate pressure level(s) can supply hydrogen to at least one catalytic hydrocracking or hydrotreatment unit.

More exactly, the make-up hydrogen required for operation of zones (II) and (IV) arrives at a pressure of between 1 and 3.5 MPa, and preferably between 2 and 2.5 MPa by a pipe (4) in zone (I) where it is compressed, optionally with other recycling hydrogen flows, in a multistage compression system. Each compression stage (1, 2 and 3), three in the figures, is separated from the following by a liquid-vapor separation and cooling system (33), (34) and (35) allowing the gas temperature and the amount of liquid carried to the following compression stage to be reduced. The pipes allowing evacuation of this liquid are not shown in the figures.

Between the first and last stage, and more often between the second and third stage, one pipe (7) routes at least part, preferably all, of the compressed hydrogen to the hydrotreatment zone (IV). The hydrogen leaving the zone (IV) through the pipe (8) is sent to the following compression stage, more often the third and last. The pipe (14) carries the hydrogen to zone (II).

The feedstock to be treated (such as defined above) enters the hydroconversion zone (II) in a boiling bed by a pipe (10). The effluent obtained in the pipe (II) is sent to the separation zone (III).

The zone (II) likewise comprises at least one pipe (12) for drawing off catalyst and at least one pipe (13) for the delivery of fresh catalyst.

This zone (II) comprises at least one three-phase boiling-bed reactor operating with a rising liquid and gas flow, containing at least one hydroconversion catalyst, of which the mineral substrate is at least partially amorphous, said reactor comprising at least one means of drawing off the catalyst to outside of said reactor located near the bottom of the reactor and at least one means of make-up of fresh catalyst in said reactor located near the top of said reactor.

Ordinarily, an operation proceeds at a pressure of from 10 to 25 MPa, often from 13 to 23 MPa, at a temperature of roughly 300° C. to roughly 500° C., and often from roughly 350 to roughly 450° C. The liquid hourly space velocity (LHSV) relative to the catalyst volume and the partial hydrogen pressure are important factors that one skilled in the art knows how to choose depending on the characteristics of the feedstock to be treated and the desired conversion. Most often, the LHSV relative to the catalyst volume is in the range of from roughly 0.1 $h^{-1}$ to 10 $h^{-1}$ and preferably roughly 0.2 $h^{-1}$ to roughly 2.5 $h^{-1}$. The amount of hydrogen mixed with the feedstock is usually from roughly 50 to roughly 5000 normal cubic meters ($Nm^3$) per cubic meter ($m^3$) of the liquid feedstock and most often from roughly 20 to roughly 1500 $Nm^3/m^3$ and preferably from roughly 400 to 1200 $Nm^3/m^3$.

The conversion in % by weight of the fraction having a boiling point exceeding 540° C. is ordinarily roughly between 10 and 98% by weight, most often between 30 and 80%.

In this hydroconversion stage, any standard catalyst can be used, especially a granular catalyst comprising, on an amorphous substrate, at least one metal or metal compound with a hydrodehydrogenating function. This catalyst can be a catalyst comprising metals of group VIII, for example nickel and/or cobalt, most often in combination with at least one metal of group VIB, for example molybdenum and/or tungsten. For example, a catalyst comprising from 0.5 to 10% by weight of nickel and preferably from 1 to 5% by weight of nickel (expressed as nickel oxide NiO), and from 1 to 30% by weight of molybdenum and preferably from 5 to 20% by weight of molybdenum (expressed as molybdenum oxide $MoO_3$) on an amorphous metal substrate can be used. This substrate will be chosen from, for example, the group formed by alumina, silica, silica-aluminas, magnesia, clays and mixtures of at least two of these minerals. This substrate can likewise contain other compounds, and, for example, oxides chosen from the group formed by boron oxide, zirconia, titanium oxide, and phosphoric anhydride. Most often, an alumina substrate is used, and very often an alumina substrate doped with phosphorus and optionally boron is used. The concentration of phosphoric anhydride $P_2O_5$ is usually less than roughly 20% by weight and most often less than roughly 10% by weight. This concentration of $P_2O_5$ is usually at least 0.001% by weight. The concentration of boron trioxide $B_2O_3$ is usually from roughly 0 to roughly 10% by weight. The alumina used is usually a γ- or η-alumina. This catalyst is most often in the form of an extrudate. The total content of oxides of metals of groups VI and VIII is often from roughly 5 to roughly 40% by weight and generally from roughly 7 to 30% by weight, and the ratio by weight expressed in terms of metal oxide between the metal (or metals) of group VI to the metal (or metals) of group VIII is generally from roughly 20 to roughly 1 and most often from roughly 10 to roughly 2.

The waste catalyst is partially replaced by fresh catalyst by drawing off fresh or new catalyst at the bottom of the reactor and introducing it at the top of the reactor at regular time intervals, i.e., for example, in bursts or almost continuously. For example, the fresh catalyst can be introduced every day. The replacement levels of the spent catalyst by the fresh catalyst can be, for example, from roughly 0.05 kilogram to roughly 10 kilograms per cubic meter of feedstock. This draw-off and this replacement are done using devices allowing continuous operation of this hydroconversion stage. The unit ordinarily comprises a pump for recirculation through the reactor allowing the catalyst to be kept in the boiling bed by continuous recycling of at least a portion of the liquid drawn off from stage (a) and reinjected into the bottom of the zone of stage (a).

The effluent obtained from stage (c) is then separated in stage (b). It is introduced by a pipe (11) into at least one separator (15) that separates, on the one hand, a gas containing hydrogen (gaseous phase) in the pipe (16) and, on the other hand, a liquid effluent in the pipe (17). A hot separator followed by a cold separator can be used. A series of hot and cold separators at medium and low pressure can likewise be present.

The liquid effluent is sent into a separator (18) that is preferably composed of at least one distillation column, and it is separated into at least one distillate fraction that includes a gas oil fraction and that is located in the pipe (21). It is likewise separated into at least one fraction that is heavier than the gas oil that is discharged by the pipe (23).

At the level of the separator (18), the acid gas can be separated in a pipe (19), the naphtha can be separated in an additional pipe (20), and the fraction that is heavier than the gas oil can be separated in a vacuum distillation column into a vacuum residue discharging by the pipe (23) and one or more pipes (22) that correspond to vacuum gas oil fractions.

The fraction from the pipe (23) can be used as an industrial fuel oil with a low sulfur content or can advantageously be sent to a carbon rejection process, such as, for example, coking.

Naphtha (20), obtained separately, optionally with the naphtha (29) separated in zone (IV) added, is advantageously separated into heavy and light gasolines, the heavy gasoline being sent to a reforming zone and the light gasoline being sent to a zone where paraffin isomerization is done.

The vacuum gas oil (22) may optionally be sent, alone or in a mixture with similar fractions of different origins, into a catalytic cracking process in which these fractions are advantageously treated under conditions allowing production of a gaseous fraction, a gasoline fraction, a gas oil fraction and a fraction that is heavier than the gas oil fraction that is often called the slurry fraction by one skilled in the art. They can likewise be sent into a catalytic hydrocracking process in which they are advantageously treated under conditions allowing production especially of a gaseous fraction, a gasoline fraction, or a gas oil fraction.

In FIGS. 1 and 2, the separation zone (III) formed by the separators (15) and (18) is shown by dotted lines.

For distillation, the conditions are, of course, chosen depending on the initial feedstock. If the initial feedstock is a vacuum gas oil, the conditions will be more rigorous than if the initial feedstock is an atmospheric gas oil. For an atmospheric gas oil, conditions are generally chosen such that the initial boiling point of the heavy fraction is from roughly 340° C. to roughly 400° C., and for a vacuum gas oil, they are generally chosen such that the initial boiling point of the heavy fraction is from roughly 540° C. to roughly 700° C.

For naphtha, the final boiling point is between roughly 120° C. and roughly 180° C.

The gas oil is between the naphtha and the heavy fractions.

The fraction points given here are indicative, but the operator will choose the fraction point depending on the quality and the quantity of the desired products, as is generally practiced.

At the outlet of stage (b), the gas oil fraction most often has a sulfur content of between 100 and 10,000 ppm, and the gasoline fraction most often has a sulfur content of at most 1000 ppm. The gas oil fraction thus does not meet 2005 sulfur specifications. The other gas oil characteristics are likewise at a low level; for example, cetane is on the order of 45, and the aromatic compound content is greater than 20% by weight; the nitrogen content is most often between 500 and 3000 ppm.

The gas oil fraction is then sent (alone or optionally with an external naphtha and/or gas oil fraction added to the process) into a hydrotreatment zone (IV) provided with at least one fixed bed of a hydrotreatment catalyst in order to reduce the sulfur content to below 50 ppm, preferably below 20 ppm, and even more preferably below 10 ppm. It is likewise necessary to significantly reduce the nitrogen content of the gas oil to obtain a desulfurized product with a stable color.

It is possible to add to said gas oil fraction a fraction that is produced outside the process according to the invention, which normally cannot be directly incorporated into the gas oil pool. This hydrocarbon fraction can be chosen from, for example, the group formed by the LCO (light cycle oil) originating from fluidized-bed catalytic cracking as well as a gas oil that is obtained from a high-pressure hydroconversion process of a vacuum distillation gas oil.

Ordinarily, an operation proceeds at a total pressure of from roughly 4.5 to 13 MPa, preferably from roughly 9 to 11 MPa. The temperature in this stage is ordinarily from roughly 200 to roughly 500° C., preferably from roughly 330 to roughly 410° C. This temperature is ordinarily adjusted depending on the desired level of hydrodesulfurization and/or saturation of aromatic compounds and must be compatible with the desired cycle duration. The liquid hourly space velocity or LHSV and the partial hydrogen pressure are chosen depending on the characteristics of the feedstock to be treated and the desired conversion. Most often, the LHSV is in the range from roughly 0.1 $h^{-1}$ to 10 $h^{-1}$ and preferably 0.1 $h^{-1}$-5 $h^{-1}$ and advantageously from roughly 0.2 $h^{-1}$ to roughly 2 $h^{-1}$.

The total amount of hydrogen mixed with the feedstock depends largely on the hydrogen consumption from stage b) as well as the recycled purified hydrogen gas sent to stage a). It is, however, usually from roughly 100 to roughly 5000 normal cubic meters ($Nm^3$) per cubic meter ($m^3$) of the liquid feedstock and most often from roughly 150 to 1000 $Nm^3/m^3$.

The operation of stage d) in the presence of a large amount of hydrogen makes it possible to usefully reduce the partial pressure of ammonia. In the preferred case of this invention, the partial pressure of ammonia is generally less than 0.5 MPa.

An operation is likewise usefully carried out with a reduced partial hydrogen sulfide pressure compatible with the stability of the sulfide catalysts. In the preferred case of this invention, the partial hydrogen sulfide pressure is generally less than 0.5 MPa.

In the hydrodesulfurization zone, the ideal catalyst must have a strong hydrogenation capacity so as to accomplish thorough refinement of the products and to obtain a major reduction of sulfur and nitrogen. According to the preferred embodiment of the invention, the hydrotreatment zone operates at a relatively low temperature; this points in the direction of thorough hydrogenation, thus an improvement of the content of aromatic compounds of the product and its cetane index and limitation of coking. It is within the framework of this invention to use in the hydrotreatment zone a single catalyst or several different catalysts simultaneously or in succession. Usually, this stage is carried out industrially in one or more reactors with one or more catalytic beds and with descending liquid flow.

In the hydrotreatment zone, at least one fixed bed of the hydrotreatment catalyst comprising a hydrodehydrogenating function and an amorphous substrate is used. A catalyst is preferably used whose substrate is chosen from, for example, the group formed by alumina, silica, silica-aluminas, magnesia, clays and mixtures of at least two of these minerals. This substrate can likewise contain other compounds and, for example, oxides chosen from the group formed by boron oxide, zirconia, titanium oxide, and phosphoric anhydride. Most often, an alumina substrate is used and, better, η- or γ-alumina. The hydrogenating function is ensured by at least one metal of group VIII, for example nickel and/or cobalt, optionally in combination with a metal of group VIB, for example molybdenum and/or tungsten. Preferably, a catalyst based on NiMo will be used. For gas oils that are difficult to hydrotreat and for very high levels of hydrodesulfurization, one skilled in the art knows that desulfurization of an NiMo-based catalyst is superior to that of a CoMo catalyst because the former has a greater hydrogenating function than the latter. For example, a catalyst can be used that comprises from 0.5 to 10% by weight of nickel and preferably from 1 to 5% by weight of nickel (expressed as nickel oxide NiO), and from 1 to 30% by weight of molybdenum and preferably from 5 to 20% by weight of molybdenum (expressed as molybdenum oxide ($MoO_3$)) on an amorphous mineral substrate. In an advantageous case, the total content of oxides of metals of groups VI and VIII is often from roughly 5 to roughly 40% by weight and generally from roughly 7 to 30% by weight, and the ratio by weight expressed in terms of metal oxide between the metal (metals) of group VI to the metal (or metals) of group VIII is generally from roughly 20 to roughly 1 and most often from roughly 10 to roughly 2.

The catalyst can likewise contain an element such as phosphorus and/or boron. This element may have been introduced into the matrix or may have been deposited on the substrate. Silicon can likewise be deposited on the substrate, alone or with phosphorus and/or boron. The concentration of said element is usually less than roughly 20% by weight (computed oxide) and most often less than roughly 10% by weight, and it is ordinarily at least 0.001% by weight. The concentration of boron trioxide $B_2O_3$ is usually from roughly 0 to roughly 10% by weight.

Preferred catalysts contain silicon deposited on a substrate (such as alumina), optionally with P and/or B likewise deposited, and also containing at least one metal of group VIII (Ni, Co) and at least one metal of group VIB (W, Mo).

The hydrotreated effluent that is obtained leaves by the pipe (25) to be sent to the separation zone (V) shown schematically by dotted lines in FIGS. 1 and 2.

Here, it comprises a separator (26), preferably a cold separator, where a gaseous phase leaving by the pipe (8) and a liquid phase leaving by the pipe (27) are separated.

The liquid phase is sent into a separator (31), preferably a stripper, to remove the hydrogen sulfide leaving in the pipe (28), most often mixed with naphtha. A gas oil fraction is drawn off by the pipe (30), a fraction that meets sulfur specifications, i.e., having less than 50 ppm of sulfur, and generally less than 20 ppm of sulfur, or even less than 10 ppm. The $H_2S$-naphtha mixture is then optionally treated to recover the purified naphtha fraction. Separation can also be done at the level of the separator (31), and the naphtha can be drawn off by the pipe (29).

The process according to the invention likewise advantageously comprises a hydrogen recycling loop for the 2 zones (II) and (IV) that can be independent for the two zones, but preferably shared, and that is now described based on FIG. 1.

The gas containing the hydrogen (gaseous phase from the pipe (16) separated in the zone (III)) is treated to reduce its sulfur content and optionally to eliminate the hydrocarbon compounds that have been able to pass during separation.

Advantageously and according to FIG. 1, the gaseous phase from the pipe (16) enters a purification and cooling system (36). It is sent to an air cooler after having been washed by injected water and partially condensed by a recycled hydrocarbon fraction from the low-temperature section downstream from the air cooler. The effluent from the air cooler is sent to a separation zone where a hydrocarbon fraction and a gaseous phase are separated [from] the water.

A portion of the recycled hydrocarbon fraction is sent to the separation zone (III), and advantageously to the pipe (37).

The gaseous phase that is obtained and from which hydrocarbon compounds have been removed is sent if necessary to a treatment unit to reduce the sulfur content. Advantageously, it is treated with at least one amine.

In certain cases, it is enough that only a portion of the gaseous phase is treated. In other cases, all of it will have to be treated.

The hydrogen-containing gas that has thus optionally been purified is then sent to a purification system that makes it possible to obtain hydrogen with a purity comparable to make-up hydrogen.

A membrane purification system offers an economical means of separating hydrogen from other light gases based on a permeation technology. An alternative system could be purification by adsorption with regeneration by pressure variation known under the term Pressure Swing Adsorption (PSA). A third technology or a combination of several technologies could likewise be envisioned.

At the outlet of the purification system, one or more pipes (5) and (6) allow recycling of purified hydrogen to the zone (I), normally at one or more pressure levels. Direct recycling to the feed (38) of the zone (II) can also be envisioned, and in this case, purification of this flow by membranes or PSA is no longer necessary.

One particular embodiment has been described here for separation of the entrained hydrocarbon compounds; any other embodiment known to one skilled in the art is suitable.

In the preferred embodiment of FIG. 1, all of the make-up hydrogen is introduced by the pipe (7) at the level of the zone (IV).

According to another embodiment, a pipe bringing solely some of the hydrogen at the level of zone (IV) can be provided.

According to another embodiment illustrated in FIG. 2, the compressed hydrogen originating from the first compression stage is brought via the pipe (41) to a straight-run gas oil hydrotreatment unit 40 and the compressed hydrogen originating from the second compression stage is brought via the pipe 54 to a soft hydrocracking reactor 50.

The zone (IV) being able to benefit from a high flow rate of high-purity hydrogen operates at a partial hydrogen pressure very near the total pressure and for the same reason at very low partial pressures of hydrogen sulfide and ammonia. This makes it possible to advantageously reduce the total pressure and the amounts of catalyst necessary to obtain the specifications for the gas oil that is produced and overall to minimize investments.

The process of the invention is implemented in an installation comprising the following reaction zones:

a single hydrogen compression zone composed of n compression stages arranged in series, n being between 2 and 6, preferably between 2 and 5, preferably between 2 and 4 and being more preferably equal to 3, a catalytic hydroconversion zone (II) composed of at least one boiling-bed reactor with a rising liquid and gas flow, supplied with hydrogen via the last compression stage, and connected via the pipe (11) to a separation zone (III) composed of at least one separator (15) and at least one distillation column (18), the separator allowing separation of a hydrogen-rich gas via the pipe (16) and a liquid phase that is brought via the pipe (17) to the distillation column (18), the pipe (21) drawing off the distilled gas oil fraction is connected to a hydrotreatment zone (IV) composed of a fixed-bed hydrotreatment reactor that is supplied with hydrogen by an intermediate compression stage, and of which the effluent pipe (25) is connected to a separation zone (V) allowing evacuation of hydrogen to the last compression stage.

Thus, according to one embodiment of the invention, the installation is such as that shown in a diagram in FIG. 1.

The detail of the various reaction zones is such as has been described above in conjunction with the description of the process.

According to one particular embodiment, in the installation according to the invention, an intermediate compression stage, the first one in FIG. 2, is connected to a straight-run gas oil hydrotreatment reactor (40).

According to another embodiment, in the installation according to the invention, an intermediate compression stage, the second one in FIG. 2, is connected to a soft hydrocracking reactor (50).

These two embodiments can be combined as is illustrated here in FIG. 2.

According to another embodiment, in the installation according to the invention, an intermediate compression stage is connected to a high-pressure hydrocracking reactor (not shown).

The installation can include one or the other, two or three among a straight-run gas oil hydrotreatment reactor (40), a soft hydrocracking reactor (50) and a high-pressure hydrocracking reactor.

The invention also relates to the use in an installation for conversion of a heavy petroleum feedstock in a boiling bed of a single multistage hydrogen compressor.

The invention will be illustrated using the following examples that are not limiting.

EXAMPLES

Example 1

In an installation according to the invention (as illustrated in FIG. 1) with a single, three-stage compression system, the conversion of a vacuum residue of the Oural type (Russian Export Blend) is conducted in a boiling bed with integrated production by means of fixed-bed hydrotreatment of middle distillates with a sulfur content of 10 ppm.

The catalyst used for hydroconversion is a high-conversion, low-sediment NiMo-type catalyst such as the catalyst HOC458 marketed by the AXENS Company.

Hydroconversion is carried out as far as 70% volumetric conversion of the fraction with a boiling point of greater than 538° C.

The boiling bed is supplied with the delivery hydrogen from the 3rd compression stage.

The operating conditions of the boiling bed are as follows:

| | |
|---|---|
| Temperature | 425° C. |
| Pressure | 17.7 MPa |
| LHSV | 0.315 $h^{-1}$ |
| Partial $H_2$ pressure at output (11) | 71 $kg/cm^2$ |

Fixed-bed hydrotreatment is then done using an NiMo-type catalyst such as the catalyst HR4158 marketed by the AXENS Company.

The fixed bed is supplied with the delivery hydrogen from the second compression stage.

The operating conditions of the fixed-bed hydrotreatment reactor are as follows:

| | |
|---|---|
| Temperature | 350° C. |
| Pressure | 8.5 MPa |
| Partial $H_2$ pressure at output | 71 $kg/cm^2$ |
| $H_2$/feedstock | 440 $Nm^3/m^3$ |

The LHSV is fixed so as to obtain a sulfur content of 10 ppm at the output.

Example 2

For Comparison

In an installation such as is described in Patent Application EP 1 312 661, conversion of a residue identical to the residue treated in Example 1 in a boiling bed is conducted with integrated production by means of a fixed-bed hydrotreatment of middle distillates with a sulfur content of 10 ppm.

The catalysts used for hydroconversion and hydrotreatment are identical to those used in Example 1. They have the same life cycle length as in Example 1.

The feedstock flow rate is identical to that of Example 1.

Hydroconversion is carried out under the same conditions as in Example 1.

Fixed-bed hydrotreatment is carried out under the following conditions:

| | |
|---|---|
| Temperature | 350° C. |
| Pressure | 17.2 MPa |
| Partial $H_2$ pressure at output | 143 $kg/cm^2$ |
| $H_2$/feedstock | 440 $Nm^3/m^3$ |

The LHSV is fixed so as to obtain a sulfur content of 10 ppm at the output. The LHSV is less than the LHSV of Example 1.

Taking into account the decrease of the pressure implemented in the hydrotreatment reactor, the invention makes it possible to significantly reduce investments in equipment, especially because all of the equipment used for zones IV and V of the installation operates at a lower pressure.

Thus, if the installation used for Example 2 has an investment cost I, the investment cost for the installation according to the invention allowing implementation of Example 1 is 0.72 I. The quality of the products obtained according to the two examples is identical.

The entire disclosure of all applications, patents and publications, cited herein are incorporated by reference herein,

Figure 1:
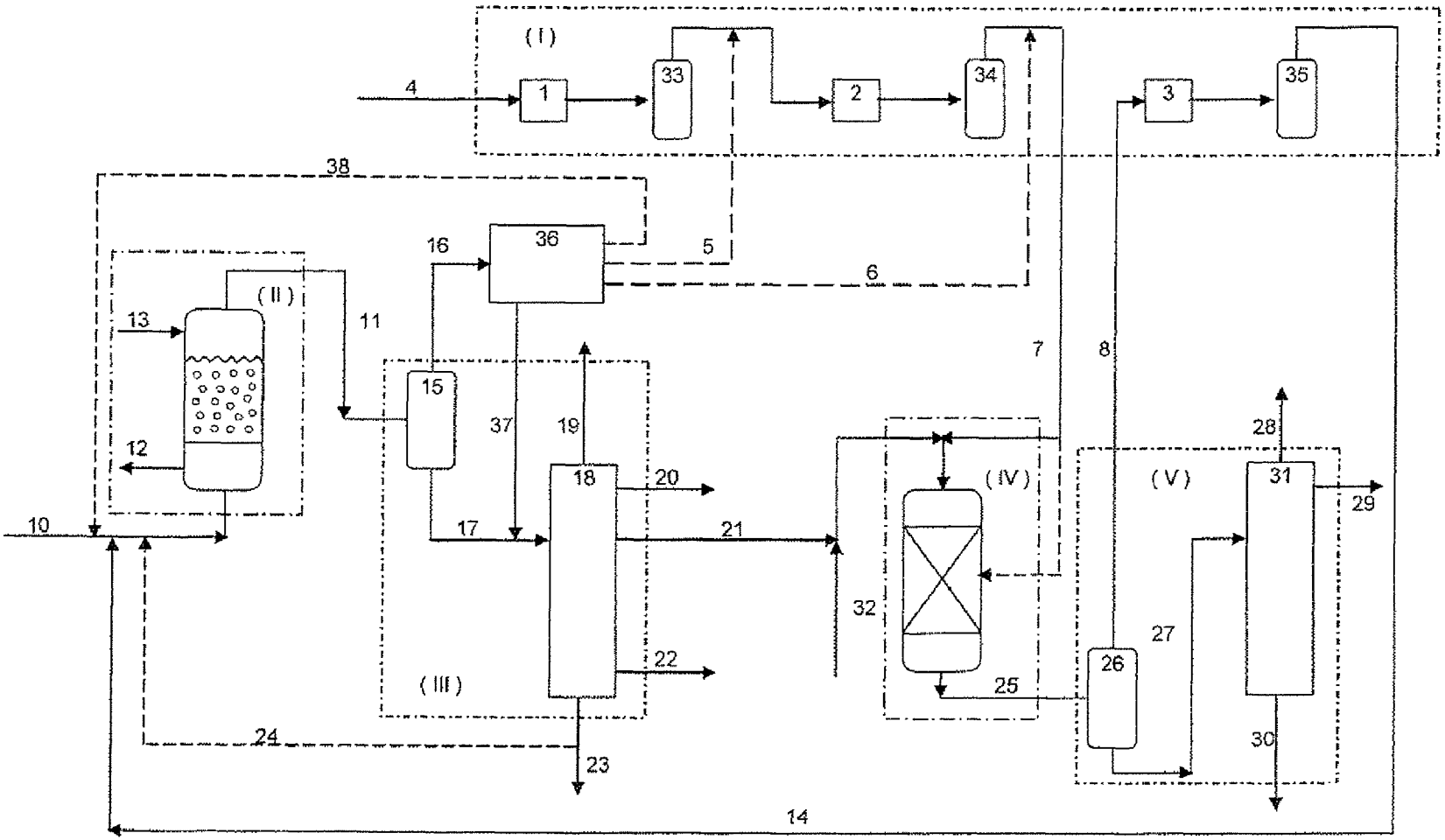
FIG. 1 illustrates an installation allowing implementation of an embodiment of a disclosed process.
Figure 2:
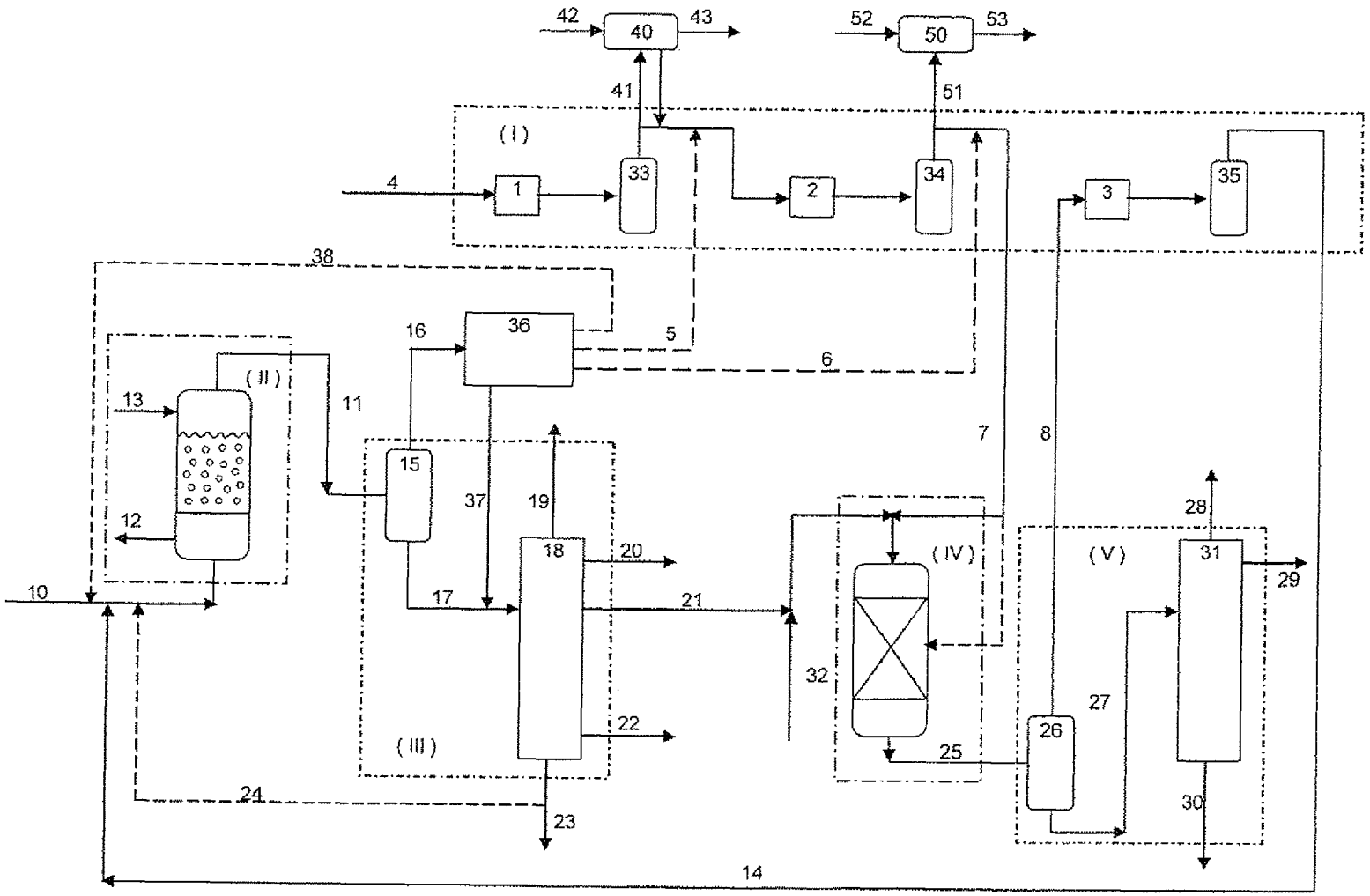
FIG. 2 illustrates an installation allowing implementation of another embodiment of a disclosed process.
Figure 3:
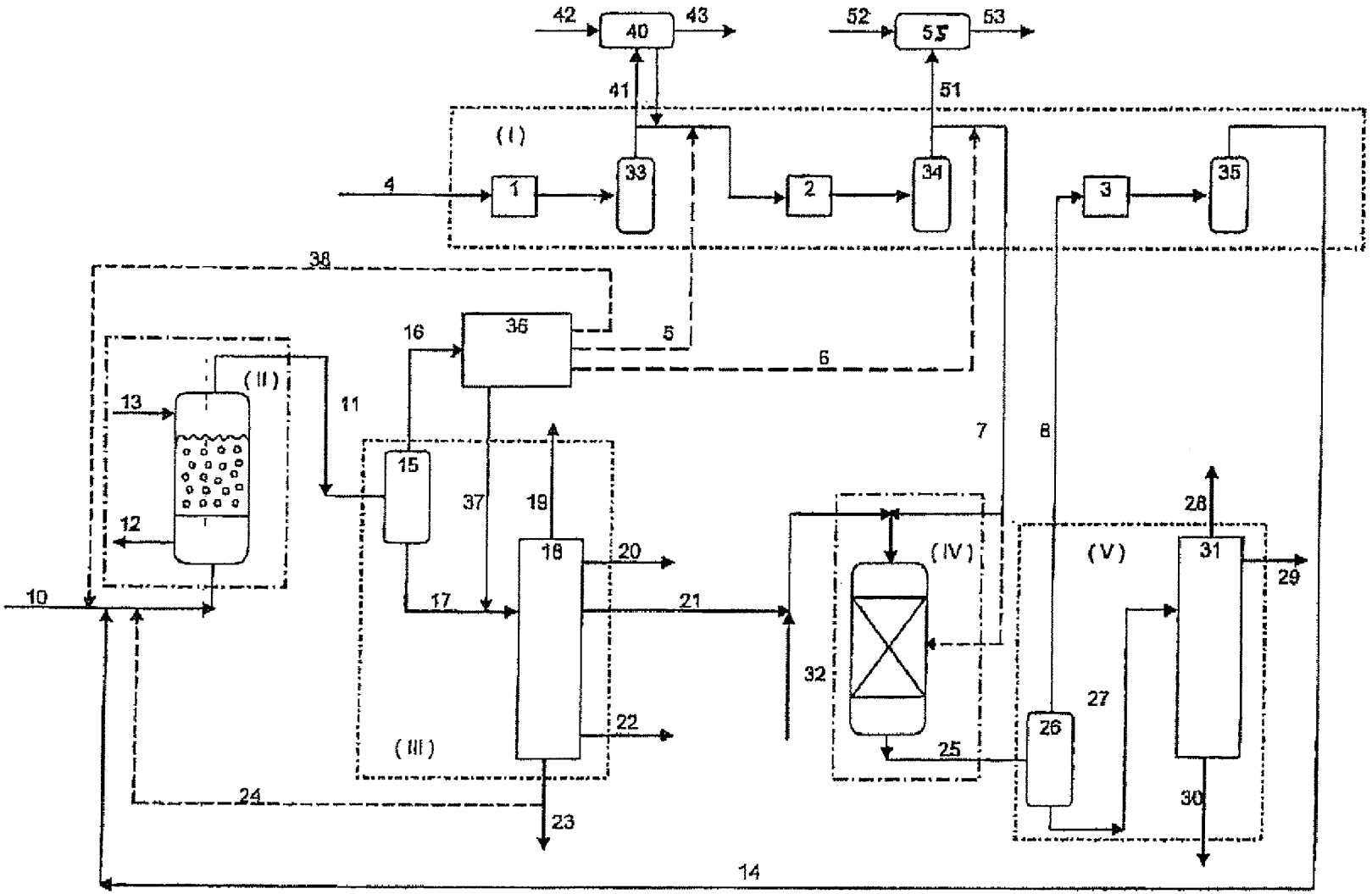
FIG. 3 illustrates a further installation allowing implementation of an embodiment of a disclosed process.
Figure 4:
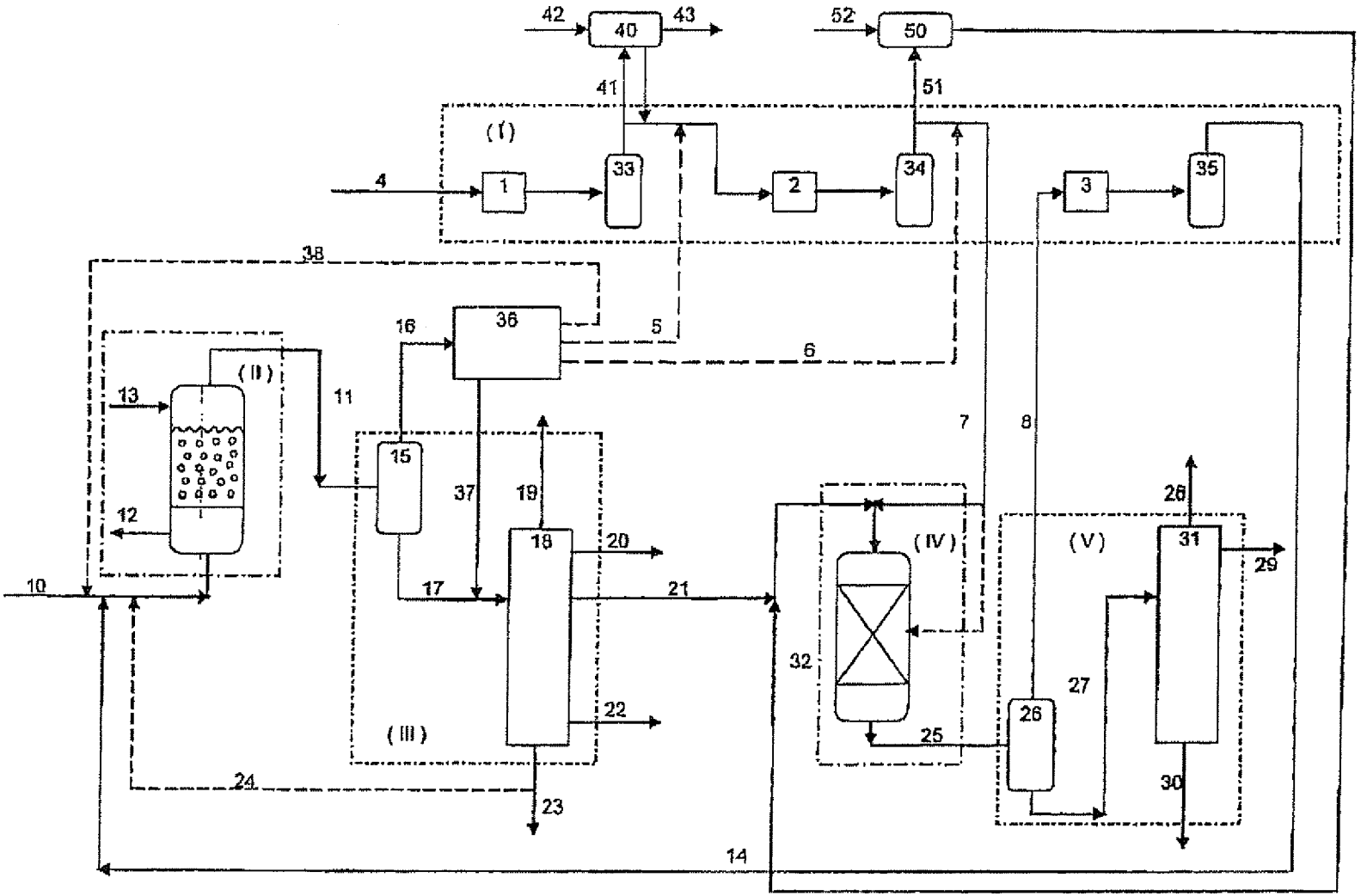
FIG. 4 illustrates another installation allowing implementation of an a further embodiment of a disclosed process.

The invention claimed is:

1. Installation for treatment of a heavy petroleum feedstock comprising the following reaction zones:

a single hydrogen compression zone containing n compression stages arranged in series, n being greater than or equal to 3, a catalytic hydroconversion zone (II) containing at least one catalytic boiling-bed reactor with a rising liquid and gas flow, supplied with hydrogen via the last compression stage, and connected via a pipe (11) to a separation zone (III) containing at least one separator (15) and at least one distillation column (18), the separator allowing separation of a hydrogen-rich gas via a pipe (16) and a liquid phase that is brought via a pipe (17) to the distillation column (18), a pipe (21) drawing off a distilled gas oil fraction from the distillation column (18) is connected to a hydrotreatment zone (IV) containing a fixed-bed hydrotreatment reactor that is supplied with hydrogen by an intermediate compression stage, and whose effluent pipe (25) is connected to a separation zone (V) allowing evacuation of hydrogen to the last compression stage.

2. Installation according to claim 1, in which n is 3 to 6.

3. Installation according to claim 2, in which n is 3 to 5.

4. Installation according to claim 3, in which n is 3 to 4.

5. Installation according to claim 4, in which n is equal to 3.

6. Installation according to claim 1, in which the delivery from an intermediate compression stage feeds a straight-run gas oil hydrotreatment reactor.

7. Installation according to claim 1, in which the delivery from an intermediate compression stage feeds a soft hydrocracking reactor (50).

8. Installation according to claim 1, according to which the delivery from an intermediate compression stage feeds a high-pressure hydrocracking reactor.

* * * * *